US005837100A

United States Patent [19]

Gerli et al.

[11] Patent Number: 5,837,100

[45] **Date of Patent: *Nov. 17, 1998**

[54] USE OF BLENDS OF DISPERSION POLYMERS AND COAGULANTS FOR COATED BROKE TREATMENT

[75] Inventors: Alessandra Gerli, Leiden; David I. Weinstein, Wassenaar, both of Netherlands

[73] Assignee: Nalco Chemical Company, Naperville, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 675,134

[22] Filed: Jul. 3, 1996

[51] Int. Cl.[6] ..... D21H 17/45

[52] U.S. Cl. ..... 162/168.2; 162/168.3; 162/191

[58] Field of Search ..... 162/183, 168.1, 162/168.3, 164.6, 191, 189, DIG. 4, 168.2, 158

[56] References Cited

U.S. PATENT DOCUMENTS

| | | | |
|---|---|---|---|
| 4,268,352 | 5/1981 | Cosper et al. | 162/191 |
| 4,370,464 | 1/1983 | Tanaka et al. | 528/99 |
| 4,388,150 | 6/1983 | Sunden et al. . | |
| 4,476,323 | 10/1984 | Hellsten et al. | 564/294 |
| 4,735,682 | 4/1988 | Didwania et al. | 162/8 |
| 4,753,710 | 6/1988 | Langley et al. | 162/164.3 |
| 4,913,775 | 4/1990 | Langley et al. . | |
| 4,929,655 | 5/1990 | Takeda et al. | 524/458 |
| 4,997,523 | 3/1991 | Pease et al. | 162/5 |
| 5,131,982 | 7/1992 | St. John | 162/168.2 |
| 5,300,194 | 4/1994 | Welkener et al. | 162/199 |
| 5,403,883 | 4/1995 | Messner et al. | 524/458 |
| 5,466,338 | 11/1995 | Pearson . | |
| 5,587,415 | 12/1996 | Takeda | 524/458 |
| 5,708,071 | 1/1998 | Takeda | 524/458 |

FOREIGN PATENT DOCUMENTS

| | | |
|---|---|---|
| 62-15251 | 1/1987 | Japan . |

OTHER PUBLICATIONS

J.E. Pearson; M.R. St. John "Proper Selection of Polymeric Coagulant for Coated Broke Treatment and Consequences of Selection on Overall Wet End Chemistry", Tappi Papermakers Conference 1995, p. 523.

*Primary Examiner*—Peter Chin
*Assistant Examiner*—Jose A. Fortuna
*Attorney, Agent, or Firm*—Margaret M. Brumm; Thomas M. Breininger

[57] ABSTRACT

An improved papermaking process comprising forming an aqueous coated broke papermaking slurry and adding a blend of a water-soluble dispersion polymer and a coagulant to the slurry to increase retention and/or drainage is disclosed. After addition of the polymers, the slurry is drained to form a sheet, and the sheet is dried.

4 Claims, 2 Drawing Sheets

USE OF BLENDS OF DISPERSION POLYMERS AND COAGULANTS FOR COATED BROKE TREATMENT

BACKGROUND OF THE INVENTION

1. Field of the Invention

The invention relates to the field of papermaking, and, in particular, to an improved papermaking process utilizing hydrophobic dispersion polymers to increase retention of fibers onto the paper sheet.

2. Description of the Prior Art

In the manufacture of paper an aqueous cellulosic suspension or slurry is formed into a paper sheet. The cellulosic slurry is generally diluted to a consistency (percent dry weight of solids in the slurry) of less than 1 percent, and often below 0.5 percent, ahead of the paper machine, while the finished sheet must have less than 6 weight percent water. Hence, the dewatering aspects of papermaking are extremely important to the efficiency and cost of the manufacture.

An important aspect of papermaking is retention of furnish components on and within the fiber mat being formed during papermaking. A papermaking furnish contains particles that range in size from about the 2 to 3 millimeter size of cellulosic fibers to fillers measuring only a few microns. Within this range are cellulosic fines, mineral fillers (employed to increase opacity, brightness and other paper characteristics) and other small particles that generally, without the inclusion of one or more retention aids, would pass through the spaces (pores) between the cellulosic fibers in the fiber mat being formed.

One method of improving the retention of cellulosic fines, mineral fillers and other furnish components on the fiber mat is the use of a coagulant/flocculant system, added ahead of the paper machine. In such a system there is first added to the furnish a coagulant, for instance a low molecular weight cationic synthetic polymer or a cationic starch, which coagulant generally reduces the negative surface charges present on the particles in the furnish, particularly cellulosic fines and mineral fillers, and thereby agglomerates such particles. The coagulant is followed by the addition of a flocculent. The flocculent is generally a high molecular weight anionic synthetic polymer which bridges the particles and/or agglomerates, from one surface to another, binding the particles into large agglomerates. The presence of such large agglomerates in the furnish increases retention. The agglomerates are filtered out of the water onto the fiber web, where unagglomerated particles otherwise would to a great extent pass.

One system employed to provide an improved combination of retention and dewatering is described in U.S. Pat. Nos. 4,753,710 and 4,913,775, inventors Langley et al., issued respectively Jun. 28, 1988 and Apr. 3, 1990, the disclosures of which are incorporated herein by reference. In brief, such method adds to the aqueous cellulosic papermaking suspension first a high molecular weight linear cationic polymer before shearing the suspension, followed by the addition of bentonite after shearing. The shearing generally is provided by one or more of the cleaning, mixing and pumping stages of the papermaking process, and the shearing breaks down the large flocs formed by the high molecular weight polymer into microflocs, and further agglomeration then ensues with the addition of the bentonite clay particles.

Another system uses the combination of cationic starch followed by colloidal silica to increase the amount of material retained on the web by charge neutralization and adsorption of smaller agglomerates. This system is described in U.S. Pat. No. 4,388,150, inventors Sunden et all, issued Jun. 14, 1983.

Greater retention of fines and fillers permits a reduction in the cellulosic fiber content of the paper being formed. As pulps of less quality are employed to reduce papermaking costs, the retention aspect of papermaking becomes more important because the fines content of such lower quality pulps is generally greater than that of pulps of higher quality.

Greater retention of fines, fillers and other slurry components reduces the amount of such substances lost to the white water and hence reduces the amount of material waste, the cost of waste disposal and the adverse environmental effects therefrom.

As described in the Langley patents, paper or paper board is generally made from a suspension or slurry of cellulosic material in an aqueous medium, which slurry is subjected to one or more shear stages, which stages generally are a cleaning stage, a mixing stage and a pumping stage, and thereafter the suspension is drained to form a sheet, which sheet is then dried to the desired, and generally low, water concentration. As disclosed in these patents, the cationic polymer generally has a molecular weight of at least 500,000, and preferably the molecular weight is above 1,000,000 and may be above 5,000,000, for instance in the range of from 10 to 30 million or higher. The cationic polymer is substantially linear; it may be wholly linear or it can be slightly cross linked provided its structure is still substantially linear in comparison with the globular structure of cationic starch. Preferably the cationic polymer has a relatively high charge density of for instance about 0.2 and preferably at least about 0.35, and most preferably about 0.4 to 2.5 or higher, equivalents of cationic nitrogen per kilogram of polymer. When the polymer is formed by polymerization of cationic, ethylenically unsaturated monomer, optionally with other monomers, the amount of cationic monomer will normally be above 2 mole percent and usually above 5 mole percent, and preferably above 10 mole percent, based on the total moles of monomer used in forming the polymer. The amount of the cationic polymer employed in the process, in the absence of any substantial amount of cationic binder, is typically at least 0.3 percent based on dry weight of the slurry, and preferably 0.6 percent in the substantial absence of cationic binder and 0.5 percent in the presence of cationic binder, same basis, which is from 1.1 to 10 times, and usually 3 to 6 times, the amount of cationic polymer that would be used in conventional (dual polymer) processes, and hence is considered "an excess amount" of cationic polymer. The cationic polymer is preferably added to thin stock, preferably cellulosic slurry having a consistency of 2 percent or less, and at most 3 percent. The cationic polymer may be added to prediluted slurry, or may be added to a slurry together with the dilution water.

In the pulp and papermaking industry, the fraction of paper products which do not meet minimum commercial specifications and therefore cannot be sold is called broke. The broke, which usually comprises the waste or trimming from the formed web, is a valuable source of fibers, and is returned for reuse in a papermaking operation at the same or other mill. The broke derived from paper which contains coating is referred as "Coated Broke". Coating is applied to paper to improve surface smoothness which positively influences printability, and, in some cases, to provide a uniform, bright, opaque layer to cover 'unattractive' base stock. Mills which make use of a relative high proportion of coated broke in the furnish are confronted with several problems due to the presence of the coating in their recycled furnish.

The coated materials contained on coated broke may account for ten (10) to about forty (40) weight percent of the total solids in the paper furnish. Typically, 80 to 90% of the dry formulation weight of coating is composed of pigments, and 5 to 20% of binders. Coating formulations often contain a large variety of components and are customized to meet stringent requirements with respect to both the paper coating itself and the handling properties of the coating dispersion.

Pigments typically used in paper coating include various types of clays, various types of calcium carbonates, and titanium dioxide. Other types of white pigments include satin white, barium sulfate, zinc oxide, talc, plastic pigments, alumina trihydrate, and titanium dioxide extenders. Organic or inorganic colored pigments are also used in some cases.

Coating binders fall into three classifications: starches, proteins and synthetics. Protein binders are either casein, soy extract, or animal glues. Synthetic binders are mainly latexes based on vinyl alcohol, styrene butadiene, vinyl acetate and acrylic polymers.

Mills which make use of coated broke in their furnish experience problems of sticky deposits originating from binder materials in combination with pigments and fillers. These deposits, often referred as "white pitch", can be found throughout the wet end, the press section, and the dryer section of a paper mill. They may cause operational problems such as holes or specks in the paper, felt filling, paper machine and coater breaks, and buildup of deposits on vacuum boxes, drying cylinders and calendar rolls. The consequence is frequent machine downtime and loss of runnability, and occasionally also loss of efficiency of chemical additives such as retention aids.

In the past, cationic solution polymers derived from crosslinked or linear epichlorohydrin dimethylamine (EPI-DMA), diallyldimethyl ammonium chloride (DADMAC), and ethylene dichloride ammonia (EDC/$NH_3$) reactants have been used to treat coated broke (J. E. Pearson; M. R. St. John "Proper Selection of Polymeric Coagulant for Coated Broke Treatment and Consequences of Selection on Overall Wet End Chemistry", Tappi Papermakers Conference 1995, p. 523). The goal of treating the coated broke with these polymers, referred to as "coagulants", is to anchor white pitch onto paper fibers while the pitch particles are still small and have not yet had the chance to combine into deposit-forming agglomerates. Coagulants also act to neutralize the effects of dispersing agents from the coating, which are detrimental to retention. In addition, coagulants help retain the fine coating pigments, resulting in improved ash retention. Treatment of coated broke by coagulants is presumed to be based on a charge neutralization mechanism and is often described as broke cationization. However, it has been shown that other mechanisms of aggregation, such as charge patch mechanism and bridging, may play a role in determining polymer activity.

In addition to the use of coagulants, Pearson has claimed in U.S. Pat. No. 5,466,338, the disclosure of which is incorporated herein by reference, that high molecular weight dispersion polymers with charge density much lower than that of coagulants can be successfully used to treat coated broke by coagulating white pitch. These dispersion polymers offer the advantage of requiring much less elaborate feeding equipment and will mix more effectively into the pulp system in comparison with high molecular weight emulsion polymers.

SUMMARY OF THE INVENTION

An improved papermaking process comprising forming an aqueous coated broke papermaking slurry and adding a blend of a water-soluble dispersion polymer and a coagulant to the slurry to increase retention and/or drainage is disclosed. The water-soluble polymer is formed by polymerizing a water-soluble mixture which comprises: (a) a first cationic monomer represented by the following formula (I):

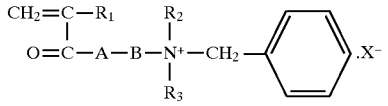

wherein $R_1$ is H or $CH_3$ each of $R_2$ and $R_3$ is an alkyl group having 1 to 3 carbon atoms: A is an oxygen atom or NH: B is an alkylene group of 2 to 4 carbon atoms or a hydroxypropylene group: and $X^-$ is an anionic counterion, and/or a second cationic monomer represented by the following general formula (II):

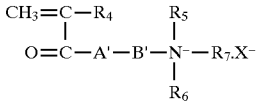

wherein $R_4$ is H or $CH_3$: each of $R_5$ and $R_6$ is an alkyl group having 1 to 2 carbon atoms: $R_7$ is H or an alkyl group of 1 to 2 carbon atoms: A' is an oxygen atom or NH: B' is an alkylene group of 2 to 4 carbon atoms or a hydroxypropylene group: and $X^-$ is an anionic counterion: and (b) (meth)acrylamide in an aqueous solution of a polyvalent anion salt, wherein the polymerization is carried out in the presence of either an organic high-molecular multivalent cation comprising a water-soluble polymer containing at least one monomer of formula (II) or an alkyl ester of acrylic acid. After addition of the blend, the slurry is drained to form a sheet, and the sheet is dried.

DESCRIPTION OF THE PREFERRED EMBODIMENTS

Figure 1:
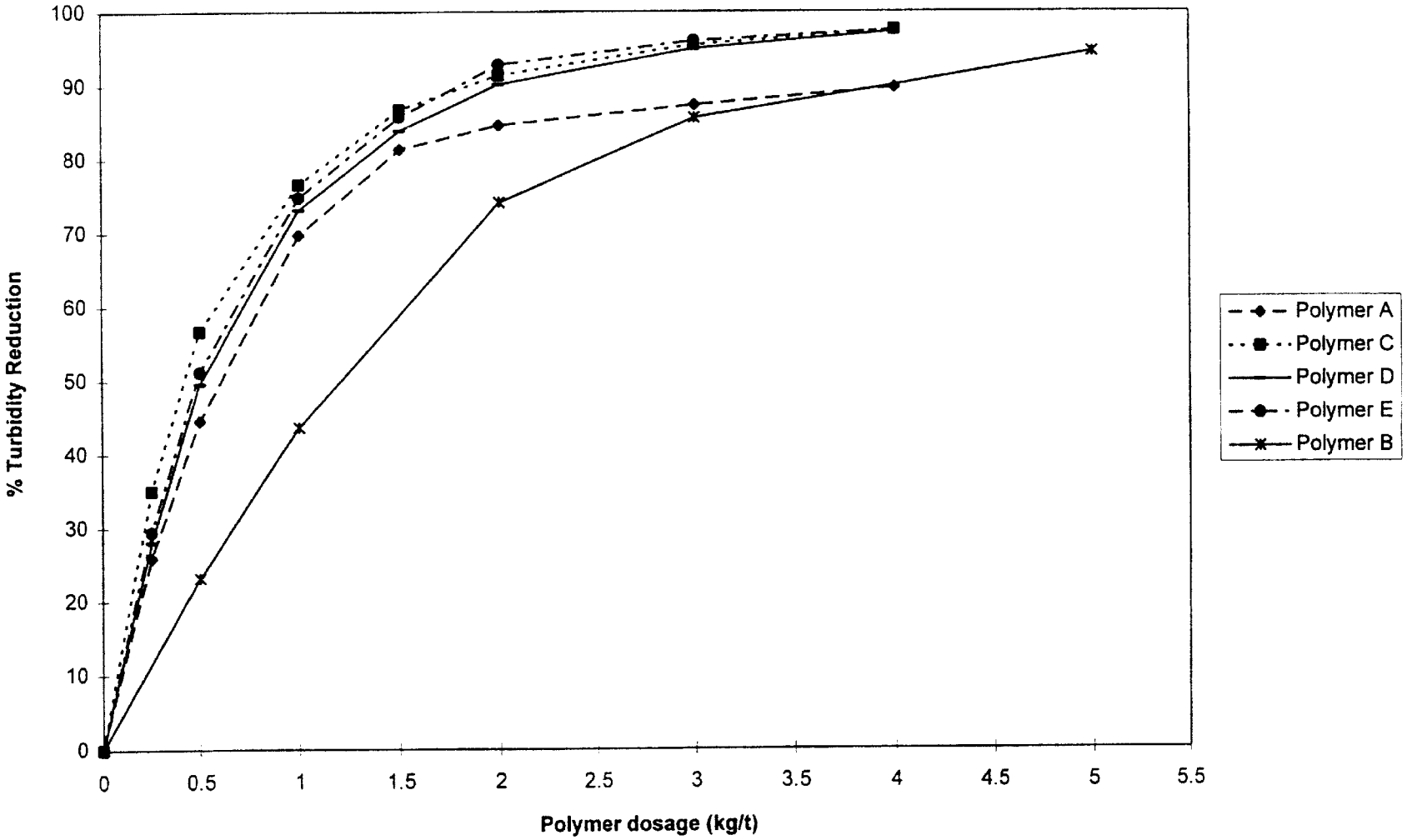
FIG. 1 is a graph comparing turbidity reduction data for a solution polymer referred to as "coagulant", dispersion polymers, and blends of the two polymers as described in the present invention.
Figure 2:
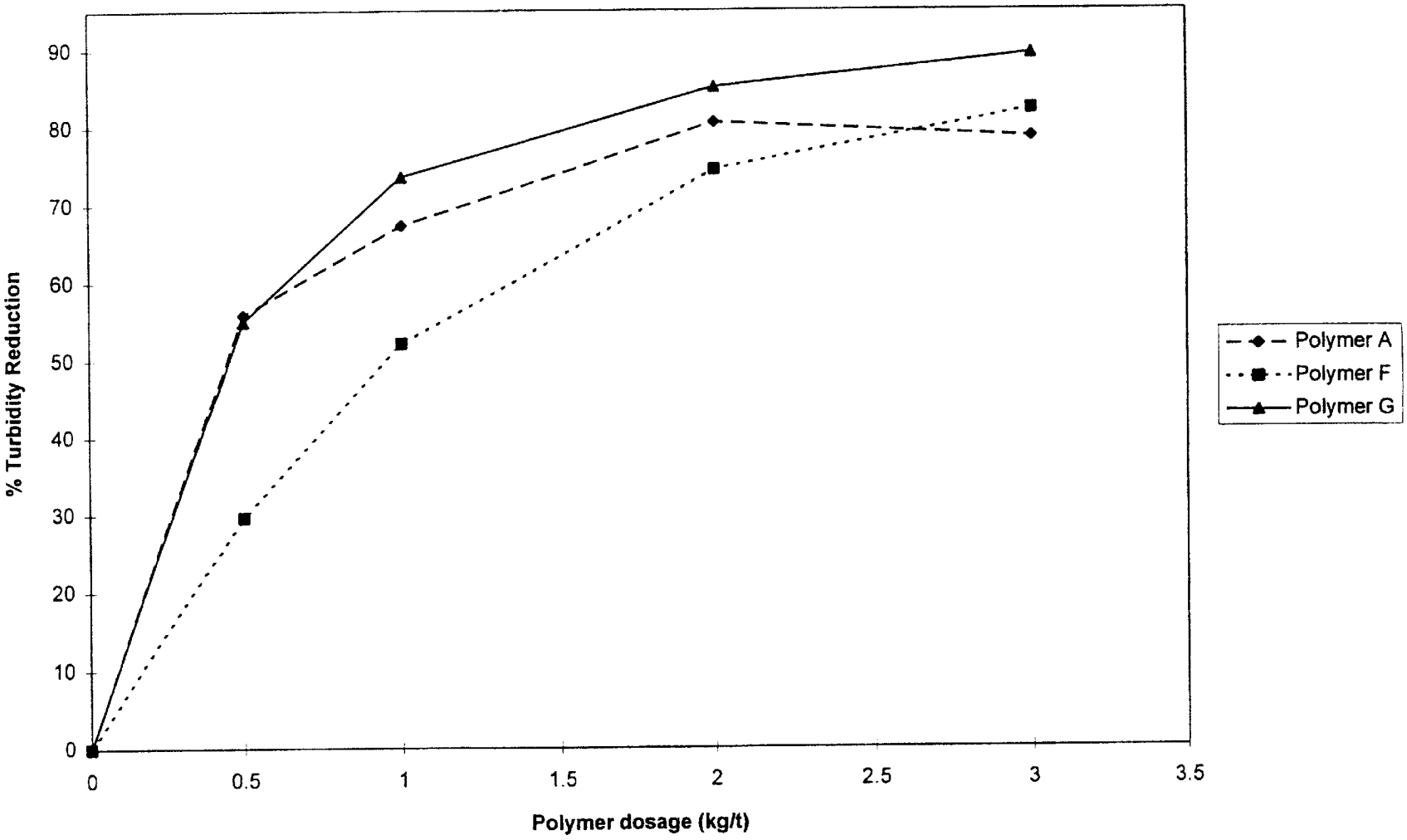
FIG. 2 is a graph comparing turbidity reduction data for a solution polymer referred to as "coagulant", dispersion polymers, and blends of the two polymers as described in the present invention.

It has now been discovered that products obtained by blending a high molecular weight dispersion polymer and a high charge coagulant show improved activity in improving retention in the manufacture of paper in comparison with the single components by themselves. Both high molecular weight and charge are polymer characteristics which have been previously found to be important for coagulating white pitch. Surprisingly, a synergistic effect is obtained by blending the two components, and the ability of these products to coagulate fines components including fiber fines coating pigments (fillers) and white pitch in a papermaking slurry is higher than that obtained with the two components added at the same time but separately to the papermaking furnish.

These blends, similarly to their components, do not require the elaborate feeding equipment utilized by emulsion polymers. The blended composition may also be applied to the treatment of wastepaper furnish containing adhesives and deinked fiber.

The blend is composed of a dispersion polymer product and a coagulant in ratios 5/95 to 95/5. The dispersion polymer product contains 15–40 weight % of dispersion polymer on an active basis. The most preferred blends contain 25 to 75 weight % of dispersion polymer product, although the weight % of dispersion polymer contained in the blend which is efficient to treat the coated broke slurry depends on the nature of the slurry itself.

The blend is added to the slurry in an amount of from about 0.1 kg product per ton of total broke solids to about 5 kg product per ton of total broke solids. Most preferably, the effective treatment ranges are between 0.25 kg product per ton of total slurry solids to about 3 kg per ton, although the treatment level demand for the blends can vary with the type of slurry being treated.

Preferably, the dispersion polymer and coagulant are blended as concentrated products prior to diluting to use levels and adding to the slurry. Alternatively the dispersion polymer and coagulant may be diluted separately and then added to the slurry.

The coagulants of the invention are preferably selected from the group consisting of epichlorohydrin dimethylamine, diallyldimethyl ammonium chloride, polyaluminum chloride, alum, polyethylenimine, dicyandiamide, ethylene dichloride aumnonia and mixtures thereof.

The following examples are presented to describe the preferred embodiments and utilities of the invention and are not meant to limit the invention unless otherwise stated in the claims appended hereto.

EXAMPLES

Coated broke slurry was prepared in the laboratory from dry broke pulped in Synthetic Chicago Tap Water #13 for 1 hour and 45 minutes by using a high consistency pulper, and successively disintegrated in a standard disintegrator for 10000 to 45000 revolutions according to the type of broke.

Reduced specific viscosity/intrinsic viscosity (RSV/IV) measurements were carried out by capillary viscosimetry under standard conditions (0.125M $NaNO_3$, 30° C.,). RSV is the polymer reduced specific viscosity at 0.045% polymer weight. IV of the polymer is the intercept of the best line calculated from RSV points at three different polymer weight concentrations. Viscosity of the blends was calculated on the basis of percent weight of dispersion polymer present in the blend. Such a calculation allows measurement of viscosity changes that the dispersion polymer undergoes upon its blending with the coagulant.

Polymers were diluted to 0.2–0.4% product for activity testing. Polymer activity was tested in wet coated broke slurry collected at the paper mill or in coated broke slurry prepared in the laboratory from dry broke as outlined above. A simple turbidity test used to evaluate polymer activity. To 200 ml of broke in a 400-ml beaker, stirred at 500 rpm by using a Britt Jar mixer, blends of a dispersion polymer and solution polymer or individual components were added at 10 seconds. In any case, stirring was stopped at 30 seconds, and the mixture was filtered through a 100-mesh sieve to the same volume of filtrate each time. By this method, retention of coated broke particles is a result of polymer activity and not filtration by the filter medium. The filtrate turbidity was measured by a standard turbidity meter (2100 N Turbidimeter by Hach Company) calibrated by using Formazin Primary Standard as suggested by the manufacturer. Retention was expressed in terms of % turbidity reduction of the filtrate from broke with no polymer treatment (blank).

EXAMPLE 1

Polymer A: EPI-DMA solution polymer

Polymer B: 90/10 AcAm/DMAEA·BCQ

Polymer C: 50/50 blend polymer A/polymer B

Polymer D: 25/75 blend polymer A/polymer B

Polymer E: 75/25 blend polymer A/polymer B

TABLE I

| Polymer | % Actives | RSV [dl/g] | IV [dl/g] |
|---|---|---|---|
| A | 45.3 | | |
| B | 15.0 | 15.1 | 12.1 |
| C | 30.2[a] | 16.2 | 13.2 |
| D | 22.6[a] | 14.0 | 11.3 |
| B | 37.7[a] | 18.8 | 15.4 |

[a]% actives of blends C, D, E, were calculated from the % actives of their two components, polymer A and polymer B.

Dosage curves based on turbidity reduction for polymers A, B, C, D, and E are presented in FIG. 1. The polymers in the example were calculated as product weight, and their dosage is based on dry weight of coated broke. FIG. 1 clearly demonstrates that polymer C, polymer D and polymer E, which are blends of polymer A and B in various ratios, exhibit the highest % turbidity reduction per product dose. In particular, polymers C, D and E have a higher efficiency (retention obtained at a fixed polymer dosage) than polymers A and B individually. The activity of the blends depends on the weight % ratio of their product components, the optimal one depending on the nature of the coated broke treated. Furthermore, it was found that the retention activity of polymers A and B added separately to the broke is lower than that of polymers C, D and E, in which the two products are premixed. In particular, addition of 1 kg/ton of polymer C produces a turbidity reduction of 76.6%, whereas polymer A and polymer B added at the same time, but separately, to the broke at a dosage of 0.5 kg/ton each, give a turbidity reduction of only 53.5%. Addition of polymer E at a dosage of2 kg/ton produces a turbidity reduction of 92.8%, whereas individual addition of polymer A (1.5 kilogram/ton) and polymer B (0.5 kilogram/ton) to the broke reduces the turbidity of only 88.8%.

As can be seen from the viscosity data reported in Table I, the viscosity of polymer B varies when this polymer is present in blends with polymer A. Therefore, the viscosity data suggest the existence of specific interactions between premixed polymer A and dispersion polymer B. These interactions may explain the enhancement of retention activity observed for the blend in comparison with the retention activities produced by the two components added at the same time but separately to the broke.

EXAMPLE 2

TABLE II

Polymer A: EPI-DMA solution polymer
Polymer F: 65/25/10 AcAm/DMAEA.BCQ/DMAEA.MCQ
Polymer G: 75/25 blend polymer A/polymer F

| Polymer | % Actives | RSV [dl/g] | IV [dl/g] |
|---|---|---|---|
| A | 45.3 | | |
| F | 20.0 | 16.3 | 13.8 |
| G | 39.0[a] | 19.4 | 15.7 |

[a]% active of blend G was calculated from the % actives of their two components, polymer A and polymer B.

Polymers A, F and G were tested on fresh wet broke used at the mill immediately after its collection. As shown in FIG.

2, polymer G, which is a blend of the coagulant A and dispersion polymer F, has efficiency and effectiveness considerably higher than those of the single components of the blend, polymers A and F. The polymers in the example are calculated as product weight, and their dosage is based on dry weight of coated broke.

Also in this case, the viscosities of the dispersion polymer which has been blended with polymer A is different from that of the dispersion polymer alone. (Table II) This change in viscosity indicates the presence of specific interactions between the coagulant and the dispersion polymer. These interactions may explain the retention activity benefits obtained by using the blends over the single products alone.

EXAMPLE 3

The activity of four polymers was tested in a wet coated broke slurry. Polymer A was an EPI-DMA solution polymer; polymer B was a 90/10 AcAm/DMAEA·BCQ dispersion polymer; polymer H was a 50/50 blend of polymer A and B, Polymer H and J had the same composition but differ in the method of preparation. Polymer H was prepared by mixing polymer A and B as concentrated products. This mixture was diluted to a working concentration of 0.285 wt % before testing. Polymer J was prepared by mixing diluted solutions of polymer A and polymer B at 0.285 wt %. Polymers H and J had the same activity. Both products outperformed their single components. Additionally, these blends outperformed their single components added at the same time but separately to the broke. These results suggest that the dispersion polymer-coagulant interactions invoked to explain activity enhancement of the blends, are favored regardless of the concentration of the dispersion polymer and coagulant.

Changes can be made in the composition, operation and arrangement of the method of the present invention described herein without departing from the concept and scope of the invention as defined in the following claims:

We claim:

1. A papermaking process comprising:

forming an aqueous coated broke slurry;

adding a blend of:

a water-soluble dispersion polymer, the water-soluble polymer being formed by polymerizing a water-soluble mixture which comprises: (a) a first cationic monomer represented by the following formula (I):

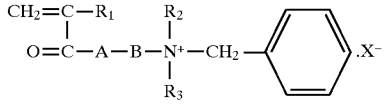

wherein $R_1$ is H or $CH_3$ each of $R_2$ and $R_3$ is an alkyl group having 1 to 3 carbon atoms; A is an oxygen atom or NH; B is an alkylene group of 2 to 4 carbon atoms or a hydroxypropylene group; and $X^-$ is an anionic counterion, and/or a second cationic monomer represented by the following general formula (II):

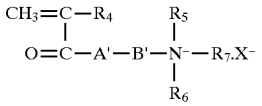

wherein $R_4$ is H or $CH_3$; each of $R_5$ and $R_6$ is an alkyl group having 1 to 2 carbon atoms; $R_7$ is H or an alkyl group of 1 to 2 carbon atoms; A' is an oxygen atom or NH; B' is an alkylene group of 2 to 4 carbon atoms or a hydroxypropylene group; and $X^-$ is an anionic counterion; and (b) (meth) acrylamide in an aqueous solution of a polyvalent anion salt;

wherein the polymerization is carried out in the presence of either an organic high-molecular weight multivalent cation comprising a water-soluble polymer containing at least one monomer of formula (II) or an alkyl ester of acrylic acid; and a cationic coagulant;

wherein the weight ratio of said water soluble dispersion and said cationic coagulant is from about 5/95 to about 95/5, and said blend is added to the coated broke slurry in amounts of from about 0.1 kilograms product per ton of broke to about 1.0 kilograms product per ton of broke draining the slurry to form a sheet; and drying the sheet.

2. The method of claim 1 wherein the blend is composed of a dispersion polvmer product and a coagulant in ratios 25/75 to 75/25.

3. The method of claim 1 wherein the blend is added to the coated broke slurry in an amount of from about 0.25 kg product per ton of total broke solids to about 1.0 kg per ton of total broke solids.

4. The method of claim 1 wherein the cationic coagulant is selected from the group consisting of epichlorohydrin dimethylamine, diallyldimethyl ammonium chloride, polyethylenimine, dicyandiamide, ethylene dichloride ammonia and mixtures thereof.

* * * * *